United States Patent [19]

Hotti

[11] 4,317,306

[45] Mar. 2, 1982

[54] BUILDING BLOCK ASSEMBLY

[76] Inventor: Martti Hotti, 44710 Taimoniemi, Finland

[21] Appl. No.: 167,918

[22] Filed: Jul. 11, 1980

[51] Int. Cl.[3] ..... A63H 33/10
[52] U.S. Cl. ..... 46/26
[58] Field of Search ..... 46/26, 30, 31, 23; D21/107, 108; 52/586

[56] References Cited

U.S. PATENT DOCUMENTS

| | | | |
|---|---|---|---|
| 669,029 | 2/1901 | Faller | 46/26 |
| 1,398,852 | 11/1921 | Gilbert | 46/31 |
| 2,231,089 | 2/1941 | Rorer | 46/26 UX |
| 2,497,657 | 2/1950 | Cole | 46/31 |
| 3,803,754 | 4/1974 | Fischer | 46/26 |
| 4,143,481 | 3/1979 | Loechel | 46/26 |

FOREIGN PATENT DOCUMENTS

| | | | |
|---|---|---|---|
| 1817273 | 10/1969 | Fed. Rep. of Germany | 46/31 |
| 416271 | 11/1946 | Italy | 46/26 |

*Primary Examiner*—F. Barry Shay
*Attorney, Agent, or Firm*—Steinberg & Raskin

[57] ABSTRACT

A building block assembly includes a plurality of prismatic building blocks, each of which has at least one substantially rectangular face portion in which a pair of substantially mutually orthogonal intersecting grooves are formed and a plurality of connecting elements for interconnecting the blocks. At least some of the connecting elements comprise a pair of intersecting connecting portions which define a substantially cross-shaped configuration, each of the connecting portions having a substantially S-shaped configuration having a depth greater than the width of the grooves while the thickness of the connecting portions is less than the width of the grooves formed in the block face portions.

6 Claims, 9 Drawing Figures

FIG. 3
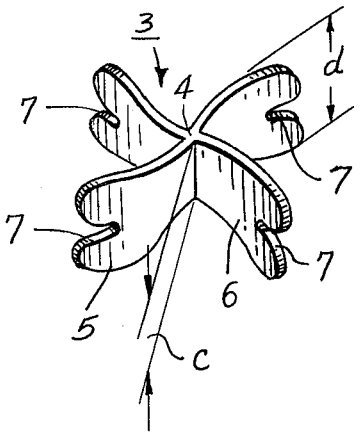
FIG. 4
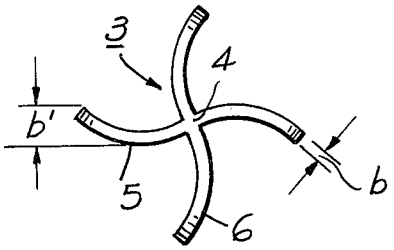
FIG. 5
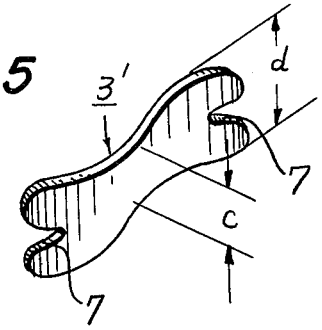
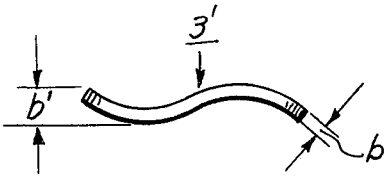
FIG. 6
FIG. 7
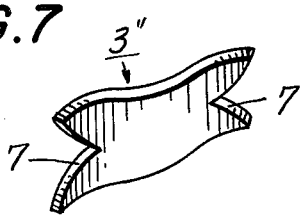
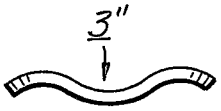
FIG. 8

BUILDING BLOCK ASSEMBLY

BACKGROUND OF THE INVENTION

This invention relates generally to building block assemblies and, more particularly, to building block assemblies comprising a plurality of prismatic building blocks having face portions in which grooves are formed and a plurality of connecting elements for interconnecting the building blocks adapted to be received within the grooves.

It is well known that children enjoy playing with building blocks and many building block assemblies are presently known and available which include a plurality of building blocks and associated connecting elements for interconnecting the same. More particularly, building block assemblies are known which include building blocks in which grooves are formed in the face portions thereof and which are interconnected to each other by means of connecting elements comprising substantially planar, or right-angle portions, whose transverse dimension is essentially equal to the width of the grooves of the building blocks. Thus, interlocking of the building blocks is accomplished by means of frictional engagement or through compression of the connecting elements and/or the building block. Examples of such conventional building block assemblies are illustrated in U.S. Pat. No. 3,803,754, published July 23, 1973 and July 6, 1978 respectively, German Patent Publications 2,203,029 and 2,658,931, German Pat. No. 136,077 published in 1901 and Swiss Pat. No. 388,158, published June 16, 1965.

Several disadvantages, however, are inherent in the conventional building block assemblies described above. More particularly, the connecting elements tend to loosen from the grooves in which they are received in some cases and in other cases where a tight fit of the connecting elements in their associated grooves is present, it frequently is the case that a child will not have sufficient strength to effect engagement or disengagement of the connecting elements and associated building blocks.

Other disadvantages of conventional building block assemblies are that the building blocks are frequently too small to allow for use by small children and that it is frequently difficult to insert the connecting elements into the receiving grooves formed in the building blocks. Further, many conventional building block assemblies must be formed entirely of plastic material and sometimes include an overly diverse number of building components of different configurations which are limited with respect to the manner in which they can be joined. Such building block assemblies generally are relatively expensive in manufacture.

SUMMARY OF THE INVENTION

Accordingly, one object of the present invention is to overcome the various disadvantages inherent in conventional building block assemblies as set forth above.

Thus, an object of the present invention is to provide a new and improved building block assembly wherein interconnected blocks will not become loose during use and wherein a child has sufficient strength to engage and/or disengage the connecting elements from the corresponding building blocks.

Another object of the present invention is to provide a new and improved building block assembly wherein insertion of the connecting elements into grooves provided in the face portions of the building blocks is facilitated.

Still another object of the present invention is to provide a new and improved building block assembly of the type described above which is relatively inexpensive to manufacture.

Briefly, in accordance with the present invention, these and other objects are attained by providing a building block assembly comprising a plurality of prismatic building blocks, each of which has at least one face portion in which a pair of intersecting grooves are formed and a plurality of connecting elements which, in the illustrated preferred embodiment, comprise a pair of intersecting flexible sheet-like connecting portions which define a substantially cross-shaped configuration. Each one of the pair of intersecting connecting portions has a substantially shallow S-shaped configuration so that the connecting element has four bowed arms. Further in accordance with the invention, the depth of the bowed arms is greater than the width of the grooves which are formed in the block face portions while the thickness of the connecting portions is less than the width of the grooves.

Connecting elements may also be included which comprise only a single connection portion which itself has a bowed or S-shaped configuration.

In order to facilitate insertion of the connecting elements into the grooves and subsequent removal therefrom, a notch is formed in the edge and at the end regions of each of the connecting portions at a substantial mid-height so that a child may through insertion of a finger therein easily remove and insert the connecting element when desired. Further, the height of each connecting portion of a pair of connecting portions which comprise a cross-shape connecting element at the line of intersection thereof is preferably smaller than the height of the connecting portions at the end regions thereof. This feature further facilitates insertion of the connecting elements into the corresponding grooves as discussed below.

According to still another feature of the invention, the building blocks are provided with beveled edge surfaces at the regions where the grooves open onto their respective face portions. Such beveled edges facilitate insertion of the connecting elements into the grooves by guiding the former into the latter. This is important especially when the building block assembly is utilized by young children who might otherwise have difficulty in inserting the connecting elements into the appropriate grooves.

DESCRIPTION OF THE DRAWINGS

A more complete appreciation of the present invention and many of the attendant advantages thereof will be readily understood by reference to the following detailed description when considered in connection with the accompanying drawings in which:

FIG. 3 is a perspective view of one embodiment of a connecting element comprising one component of the building block assembly of the present invention;

FIG. 4 is a plan view of the connecting element illustrated in FIG. 3;

FIG. 5 is a perspective view of another embodiment of a connecting element forming one component of the building block assembly of the present invention;

FIG. 6 is a plan view of the connecting element illustrated in FIG. 5;

FIG. 7 is a perspective view of yet another embodiment of a connecting element forming one component of the building block assembly of the present invention;

FIG. 8 is a plan view of the connecting element illustrated in FIG. 7; and

DESCRIPTION OF THE PREFERRED EMBODIMENTS

Figure 1:
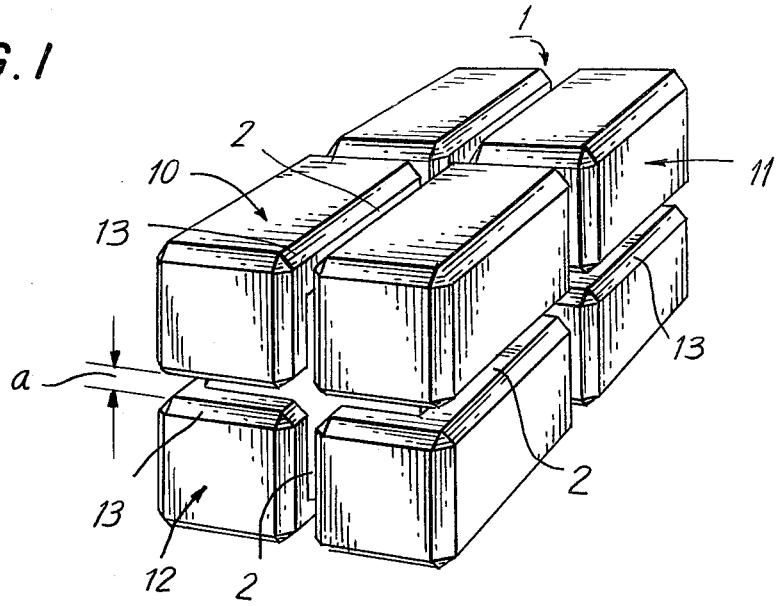
FIG. 1 is a perspective view of a building block comprising one component of the building block assembly of the present invention.

Referring now to the drawings wherein like reference characters designate identical or corresponding parts throughout the several views and more particularly to FIG. 1, a prismatic building block for use in connection with the present invention is generally designated 1. In the illustrated embodiment, the building block 1 comprises a rectangular prismatic block preferably formed of wood and having three pairs of opposed face portions 10, 11 and 12, only one face portion of each pair being illustrated. A pair of substantially mutually orthogonal intersecting grooves 2 are formed in each face portion which open onto the respective face portion. In the illustrated embodiment each groove 2 of a particular pair of intersecting grooves is located on the long and short axes, respectively, of the particular face portion in which it is formed. Each groove has a width a. Further, beveled edge surfaces 13 are formed in block 1 at the regions where the grooves 2 open onto their respective face portions of the block, which beveled surfaces facilitate insertion of the connecting elements into grooves 2 as will become apparent hereinbelow.

Figure 2:
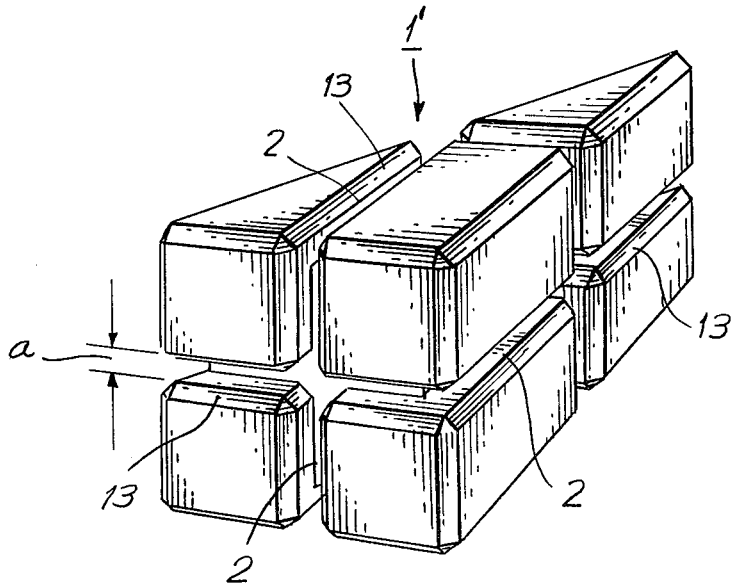
FIG. 2 is a perspective view of another type of building block forming one component of the building block assembly of the present invention.

FIG. 2 illustrates another embodiment of a prismatic building block, designated 1', which can be utilized in connection with the present invention. Thus, building block 1' includes intersecting grooves 2 formed in the face portions of block 1' and beveled edge surfaces 13 are provided adjoining the grooves on each side thereof in a manner similar to the embodiment of FIG. 1. The grooves 2 of building block 1' also have a width, designated a.

Turning now to FIGS. 3–8, various embodiments of connecting elements adapted for use in connection with the building blocks illustrated in FIGS. 1 and 2 are illustrated. Thus, referring to FIGS. 3 and 4, a connecting element 3 comprises a pair of intersecting connecting portions 5, 6 defining a substantially cross-shaped configuration. The connecting portions 5, 6, each of which comprises a sheet-like flexible material, preferably formed of polyethylene or the like, mutually intersect at a line of intersection 4.

As best seen in FIG. 4, each of the connecting portions 5, 6 has a substantially shallow or gently sloping S-shaped configuration so that each half-portion of each connecting portion has a bowed configuration. The depth of the bowed configuration is designated b 40.

According to the present invention, whereas the depth b' of the bowed configuration is greater than the width a of the grooves 2 formed in the block face portions, the thickness b of the connecting portion is less than the width of the grooves. In this manner the interlocking of the building blocks with the connecting elements is essentially based on the flexibility and bending of the connecting portions 5, 6.

Notches 7 are formed at the respective end regions of each of the connecting portions 5, 6 substantially midway along their height. Such notches have a two fold purpose, namely, for facilitating disengagement of the connecting elements from the grooves in which it is received by providing a surface which can be engaged by a child's finger and, additionally, for facilitating relatively independent associations of the upper and lower halves of the connecting element with a pair of building blocks in whose grooves they are received. Such operation will be described in greater detail below.

It is also preferred to form the connecting element 3 so that the height c of the connecting portions at the line of intersection 4 of the pair of intersecting connecting portions is smaller than the height d of the connecting portions at the end regions thereof. By this provision, the connecting elements can be inserted into the grooves 2 by aligning the line of intersection 4 with the region at which the grooves 2 intersect each other on a particular face portion of the building block and then urging the connecting portions gradually into the grooves.

Turning now to FIGS. 5–8, two other connecting elements which may be utilized in connection with the present invention are illustrated. Referring particularly to FIGS. 5 and 6, a connecting element 3' comprises a single connecting portion which is substantially similar to one of the connecting portions 5, 6 of the connecting element 3 illustrated in FIGS. 3 and 4. Thus, connecting element 3' comprises a flexible sheet-like connecting portion having a substantially shallow or gently sloping S-shaped configuration and having notches 7 provided at its end regions. The height c of the connecting element 3' at its mid-section is smaller than its height d at its end regions. A connecting element 3" is illustrated in FIGS. 7 and 8 has a bowed configuration best seen in FIG. 8 which is somewhat different from the S-shaped configuration of the connecting portions defining the connecting elements 3 and 3'.

As noted above, the building blocks are preferably formed of wood although other materials may be utilized as desired. Although polyethylene material is preferred for the connecting elements, other materials may be utilized which will provide the degree of rigidity and deformability required.

The extent to which the connecting elements are engaged in the respective grooves is determined by the extent to which the connecting portions are bowed, the particular design of the bend regions as well as the thickness of the sheet-like material which defines the connecting element. Since the connecting elements 3, 3' are narrower in their central region, the ends thereof can be inserted into the respective grooves first whereupon connector element as a whole then being urged until its bottom edge engages the bottom of the groove 2. It is noted in this connection that the connecting element 3" does not have a narrow central region. Further, the provision of the beveled edge surfaces 13 facilitate the insertion of the connecting elements since they in essence define an enlarged mouth region into which the connecting element is located and which will serve to guide the connecting element into the communicating groove.

The notches 7 have the dual function of providing a gripping surface to facilitate disengagement of the connecting element from the groove and, additionally, so that the upper and lower halve portions of the connecting element will function independently providing good gripping action with the associated building blocks.

Figure 9:
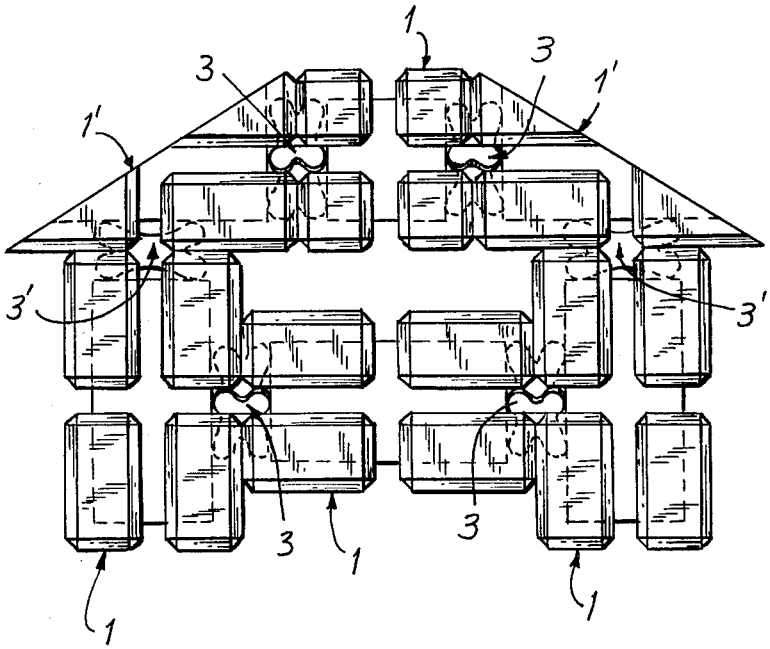
FIG. 9 is a front elevation view of a plurality of building blocks interconnected by connecting elements according to the present invention.

Referring now to FIG. 9, a typical structure constructed utilizing the building block assembly of the present invention is illustrated. Thus, the plurality of building blocks 1, 1' are seen as being associated with each other through the connecting elements 3, 3'. The line of intersection of the connecting elements 3 are located at the region at which the groove 2 on a particular face portion of a block intersect each other while the halve portions of the connecting portions communicate respectively with grooves 2 formed in adjacent face portions of respective blocks. It has been found that the connecting element 3 will provide the best engagement between a pair of adjacent blocks while the connecting element 3' is preferable for use for interconnecting the ends of the blocks. The connecting element 3'' is preferably used for the shortest engagements especially in the case of horizontally extending grooves which terminate at a diagonal side of a building block.

The building block assembly of the present invention can be used to build diverse structures limited only by the imagination and age of the child. Further, other components can be utilized with the assembly, such for example as a separate shaft component, which can be inserted into the groove 2.

Obviously, numerous modifications and variations of the present invention are possible in the light of the above teachings. It is therefore to be understood that within the scope of the claims the invention can be practiced otherwise than as specifically disclosed herein.

What is claimed is:

1. In a building block assembly including a plurality of prismatic building blocks, each building block having at least one substantially rectangular face portion in which a pair of substantially mutually orthogonal intersecting grooves are formed, said grooves opening onto said respective face portions; and a plurality of connecting elements, each of said connecting elements having at least one sheet-like flexible connecting portion receivable within said grooves, the improvement comprising: said at least one connecting portion of each connecting element having a transverse bowed configuration wherein the depth of said bowed configuration is greater than the width of said grooves formed in said block face portions while the thickness of said connecting portion is less than the width of said grooves and wherein the height of said connecting portion at a mid region thereof is smaller than the height at the end regions thereof.

2. The combination of claim 1 wherein each of said connecting portions has a substantially shallow S-shaped configuration.

3. The combination of claim 2 wherein each of at least some of said connecting elements comprises a pair of intersecting connecting portions defining a substantially cross-shaped configuration.

4. The combination of claim 3 wherein a notch is formed at the end regions of each of said connecting portions at their substantial mid-height.

5. The combination of claim 3 wherein the height of each connecting portion of a pair of connecting portions which comprise a cross-shaped connecting element at the line of intersection thereof is smaller than the height thereof at the end regions thereof.

6. The combination of claim 1 wherein said building blocks have beveled edge surfaces at the regions where said grooves open onto respective face portions of said blocks whereby said beveled edge surfaces are adapted to guide said connecting elements into said grooves.

* * * * *